US008590226B2

(12) United States Patent
Stenvall

(10) Patent No.: US 8,590,226 B2
(45) Date of Patent: Nov. 26, 2013

(54) INTERNAL GLASS HOLDER

(75) Inventor: Bo Stenvall, Sävedalen (SE)

(73) Assignee: Vida International AB, Partille (SE)

( * ) Notice: Subject to any disclaimer, the term of this patent is extended or adjusted under 35 U.S.C. 154(b) by 923 days.

(21) Appl. No.: 10/557,907

(22) PCT Filed: May 21, 2004

(86) PCT No.: PCT/SE2004/000784
§ 371 (c)(1),
(2), (4) Date: Feb. 2, 2007

(87) PCT Pub. No.: WO2004/104346
PCT Pub. Date: Dec. 2, 2004

(65) Prior Publication Data

US 2008/0053023 A1 Mar. 6, 2008

(30) Foreign Application Priority Data

May 22, 2003 (SE) ..... 0301493

(51) Int. Cl.
*E06B 7/00* (2006.01)

(52) U.S. Cl.
USPC ..... 52/204.593; 52/204.68; 52/204.62; 52/509

(58) Field of Classification Search
USPC ..... 52/204.68, 204.593, 509, 137, 208, 52/204.62
See application file for complete search history.

(56) References Cited

U.S. PATENT DOCUMENTS 4,241,152 A * 12/1980 Klink ..... 429/181
4,680,206 A * 7/1987 Yoxon et al. ..... 428/34
5,398,452 A * 3/1995 Schilde et al. ..... 49/501
5,425,208 A * 6/1995 Eekhout ..... 52/235

(Continued)

FOREIGN PATENT DOCUMENTS

CN 2439211 Y 7/2001
DE 195 27 500 A1 1/1997

(Continued)

OTHER PUBLICATIONS

Russian Decision on Grant issued in corresponding application, and English translation thereof.

(Continued)

*Primary Examiner* — Branon Painter
(74) *Attorney, Agent, or Firm* — Harness, Dickey & Pierce P.L.C.

(57) ABSTRACT

A glass element includes at least two glass slabs arranged in facing relationship with a peripheral spacer frame arranged between each pair of glass slabs, and holders for anchorage at selective points to a supporting structure. The holders, each one of which includes two clamping plates joined together via connectors, are mounted exclusively in apertures formed in the glass element slab that faces the supporting structure, i.e. the inner glass slab. One of the clamping plates of each holder fitting is formed with anchorage attachment points that are accessible from the outside, and the inner clamping plates are placed in abutment against the inner face of the inner glass slab prior to the assembly of the inner glass slab and the next glass slab, in such a manner that their connecting parts extend at most up to the outer mouth of the apertures. The connecting parts of the outer clamping plates, which outer clamping parts are applied to the external face of the inner glass slab in a later step, engage the connecting parts of the inner clamping plates and form the attachment points. Seals are arranged in said apertures in the inner glass slab and the inner clamping plates are attached to the inner face of the inner glass slab.

10 Claims, 5 Drawing Sheets

(56) References Cited

U.S. PATENT DOCUMENTS

| | | | | |
|---|---|---|---|---|
| 5,603,546 | A * | 2/1997 | Desir, Sr. | 296/93 |
| 6,430,894 | B1 * | 8/2002 | Chae et al. | 52/786.1 |
| 6,442,911 | B2 * | 9/2002 | Elmer et al. | 52/506.01 |

FOREIGN PATENT DOCUMENTS

| | | |
|---|---|---|
| EP | 0340089 | 11/1989 |
| EP | 0 552 101 A1 | 7/1993 |
| FR | 2652609 | 4/1991 |
| RU | 8722 | 12/1998 |
| WO | WO 03/062579 | 7/2003 |

OTHER PUBLICATIONS

International Search Report.

Chinese Office Action dated Oct. 16, 2009.

* cited by examiner

INTERNAL GLASS HOLDER

CROSS REFERENCE TO RELATED APPLICATION

The present application is a 35 U.S.C. §§ 371 national phase conversion of PCT/SE04/00784, filed May 21, 2004, which claims priority to Sweden Applicant No. 03011493-3 filed May 22, 2003.

TECHNICAL FIELD OF THE INVENTION

The present invention relates to a glass element comprising at least two glass slabs arranged in facing relationship with a peripheral spacer frame arranged between each pair of glass slabs, and holders for anchorage at selective points to a supporting structure, said holders, each one of which comprises two clamping plates which are joined together via connectors, being mounted exclusively in apertures formed in the glass element slab that faces the supporting structure, i.e. the inner glass slab, one of the clamping plates of each holder fitting being formed with anchorage attachment points that are accessible from the outside, and wherein the inner clamping plates are placed in abutment against the inner face of the inner glass slab prior to the assembly of said inner glass slab and the next glass slab, in such a manner that their connecting parts extend at most up to the outer mouth of the apertures, and that the connecting parts of the outer clamping plates, which outer clamping parts are applied to the external face in a later step, engage the connecting parts of the inner clamping plates and form said attachment points.

In addition, the present invention concerns a device for interconnecting two or several glass elements.

TECHNICAL BACKGROUND OF THE INVENTION

A glass element of the kind defined in the introduction is previously known from EP 0552101, wherein the inner clamping plates are glued tightly against the inner face of the inner glass slab. In order to obtain a sealed glue joint, a layer of glue of for example polyvinyl butyral is used as a rule. Many kinds of glue layers that are also sealing in some cases need a comparatively long time to solidify and thus to reach their full capacity. One consequence thereof is that for glass slabs fitted with a clamping plate a period of rest therefore is necessary, before the outer clamping plates can be joined together with the inner clamping plates.

SUMMARY OF THE INVENTION

One object of example embodiments therefore is to eliminate the period of rest after the application of the inner clamping plate on the inner face of the inner glass slab, making it possible to apply the outer clamping plates immediately.

Another object of example embodiments is to provide a device that makes it possible to fit glass elements that are secured in the inner glass slab with thin glass slabs.

In accordance with the present invention, the glass element comprises at least two glass slabs arranged in facing relationship with a peripheral spacer frame arranged between each pair of glass slabs, and holders for attachment at selected spots to a supporting structure, said holders, each one of which comprises two clamping plates which are joined together via connectors, being mounted exclusively in apertures formed in the glass element slab that faces the supporting structure, i.e. the inner glass slab, one of the clamping plates of each holder fitting being formed with anchorage attachment points that are accessible from the outside, and wherein the inner clamping plates are placed in abutment against the inner face of the inner glass slab prior to the assembly of said inner glass slab and the next glass slab in such a manner that their connecting parts extend at most up to the outer mouth of the apertures, and that the connecting parts of the outer clamping plates, which outer clamping parts are applied to the external face in a later step, engage the connecting parts of the inner clamping plates and form said attachment points, in addition to which seals are applied in said aperture in the inner glass slab and the inner clamping plates are attached to the inner face of the inner glass slab. One of the advantages thus is that the sealing and the attachment features are not included in one and the same unit. Attachment to the inner face of the inner glass slab may be effected by means of an adhesive or an adhesive layer, such as a tape that is adhesive on both sides, the adhesion force of which reaches its full capacity immediately upon application. Instead, the sealing feature is achieved independently from the attachment, in the aperture of the inner glass slab. Thus, it is without significance whether or not the sealing compound need to be cured or set but instead the outer clamping plates can be applied immediately and the glass element be mounted.

In accordance with a preferred embodiment of the invention, the seal is in the form of a sealing ring. Preferably, the aperture is dimensioned such that sealing rings of standard types may be used, which is an advantage from a cost-saving point of view.

Preferably a means is arranged axially outside of said sealing ring and said means is arranged to press the sealing ring outwards into a sealing position, when a pressure is applied on said means against the inner clamping plate. By using a plastically mouldable material for the sealing ring, such as butyl, the sealing ring may be pressed outwards to further ensure the sealing effect. Preferably, said means should be less plastic in comparison with the sealing ring and be made from a material that is softer than glass, since it is in contact with the glass in the aperture in the glass slab.

A bevelled face is made on the connector parts of the inner clamping plates to guide the sealing ring, when said means and the inner clamping plates are pressed together. Owing to the provision of a bevelled face of this kind, the seal may be guided towards the periphery of the aperture and in this manner the major part of the sealing ring may be guided towards the parts where it is most needed.

In addition, channels preferably are arranged in the inner clamping plates to allow flow of air between the inner mouth of the apertures and the outer face of the inner clamping plates in the mounted position. When the sealing ring is pressed against the inner clamping plate any air remaining between the sealing ring and the clamping plate may escape through said channels.

In accordance with another aspect of the present invention a device is provided in glass elements comprising at least two glass slabs arranged in facing relationship with a peripheral spacer frame arranged between each pair of glass slabs, and holders for attachment at selected spots to a supporting structure, said holders, each one of which comprises two clamping plates which are joined together via connectors, being mounted exclusively in apertures formed in the glass element slab that faces the supporting structure, i.e. the inner glass slab, one of the clamping plates of each holder fitting being formed with anchorage attachment points that are accessible from the outside, and wherein the inner clamping plates are placed in abutment against the inner face of the inner glass slab prior to the assembly of said inner glass slab and the next glass slab, in such a manner that their connecting parts extend at most up to the outer mouth of the apertures, and that the connecting parts of the outer clamping plates, which outer clamping parts are applied to the external face in a later step, engage the connecting parts of the inner clamping plates and form said attachment points, said device arranged to interconnect, by means of said aperture in the inner glass, at least two juxtaposed/parallel glass elements and further arranged to be connected to said supporting structure, said device additionally comprising a support member arranged to allow support thereon of two glass elements arranged in juxtaposed/parallel position. The advantage of this device is that the weight of the glass element is taken by the support member and the load is transferred direct to the supporting structure. The holders mounted in the apertures in the glass elements thus will absorb the majority of forces exerted in parallel with the axes of the apertures, since it is the support members that take the weight of the glass elements. Consequently, with this device thinner glass slabs may be used for the inner glass slab in the glass elements because these glass slabs need not be dimensioned to take their own weight in said apertures.

Preferably seals are arranged in said apertures in the inner glass slab and the inner clamping plates are attached to the inner face of the inner glass slab.

BRIEF DESCRIPTION OF THE DRAWINGS

The invention will be described in the following in more detail with reference to the accompanying drawings that for exemplifying reasons show preferred embodiments of the invention. In the drawings.

DETAILED DESCRIPTION OF PREFERRED EMBODIMENTS

Figure 1A:
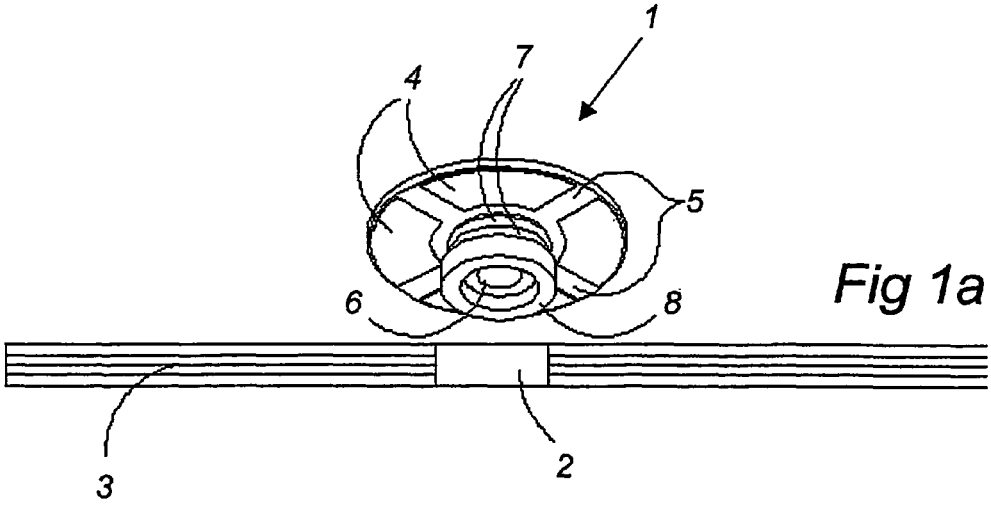
FIGS. 1*a*-1*c* show the steps of application of clamping plates on a glass slab in accordance with the invention.

To assemble a glass element in accordance with the present invention an internal clamping plate 1 made from stainless steel is initially inserted in a hole 2 formed in an inner glass slab 3, see FIG. 1*a*. The clamping plate 1 is provided with tape 4 with an adhesive on both sides in such a manner that channels 5 form extending up to the outer edge of the clamping plate 1, from a connector part 6 located in the centre of the clamping plate 1. Around the connector part 6 are arranged two sealing rings 7 made from butyl and a synthetic-resin member 8. The synthetic-resin member 8 centres the connector part 6 in the aperture 2 in the glass slab 3.

Figure 1B:
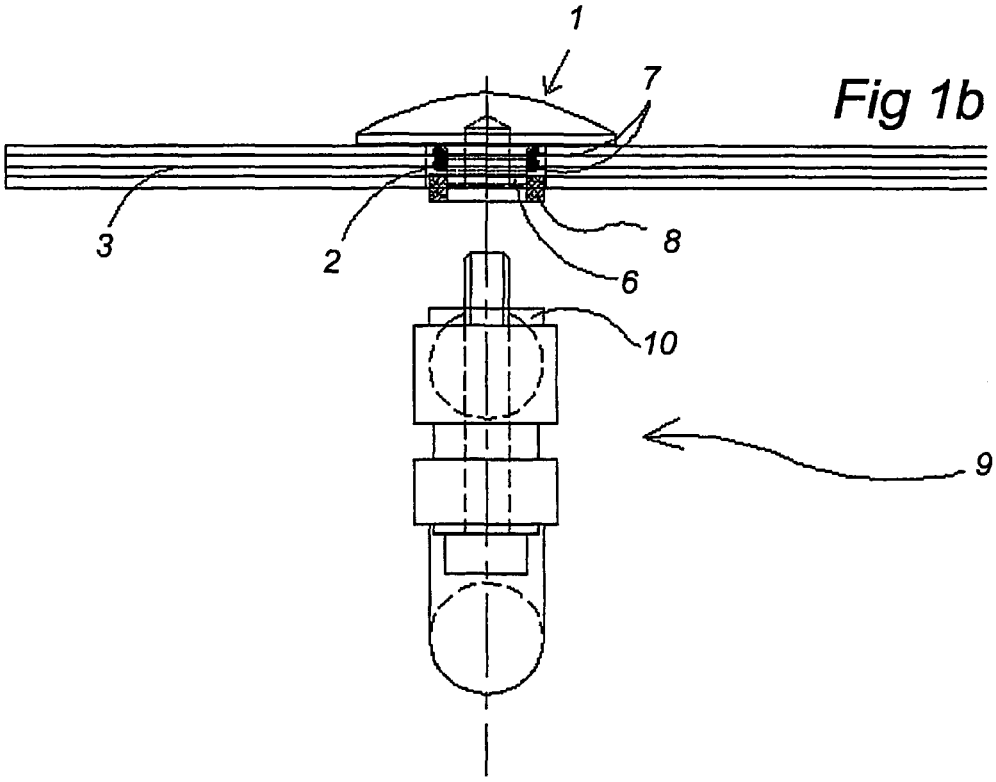
Figure 1C:
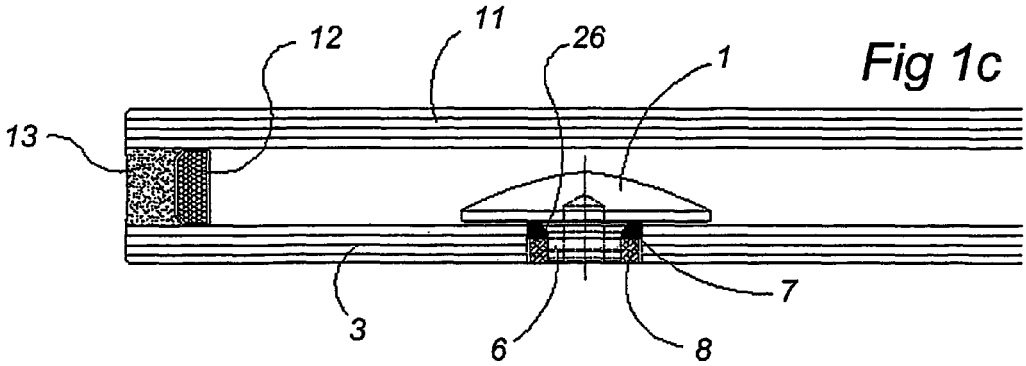

FIG. 1*b* shows the inner clamping plate 1 together with sealing rings 7 and the synthetic-resin member 8 in a partial cross-sectional view. A tool 9 is inserted into the connector part 6 in the clamping plate 1 in such a manner that an annular abutment element 10 forces the synthetic-resin member 8 inwards to ensure that the sealing rings fills up the space remaining between the clamping plate 1, the synthetic-resin member 8, and the glass slab 3, see FIG. 1*c*. An additional glass slab 11 may now be placed exteriorly of the inner glass slab 3 with the aid of a spacer frame 12 and caulking mastic 13, allowing the desired gas to be contained in the space between the glass slabs 3, 11 since it is now sealed.

Figure 1D:
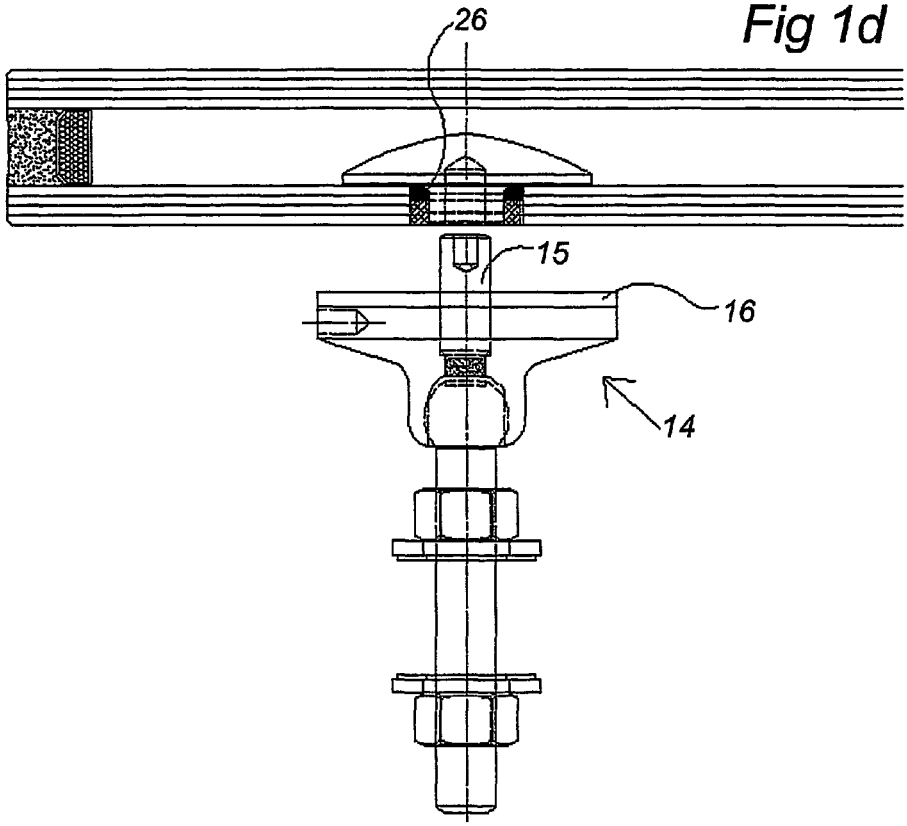

FIG. 1*d* shows the manner in which an outer clamping plate 14 with its connector part 15 is joined to the inner clamping plate 1. A synthetic-resin washer 16 preferably is inserted between the clamping plate 14 and the inner glass slab 3, when the clamping plate 14, like the inner clamping plate 1, is made from stainless steel. For example, the connector part 15 of the outer clamping plate 14 and the connector part 6 of the inner clamping plate 1 could be provided with threads to form a screw joint. In addition, the outer clamping plate 14 can be applied to an external face of the inner glass slab 3, to engage the connecting part 6 of the inner clamping plate 1 so as to make the anchorage attachment point 27 accessible to the outside.

Figure 1E:
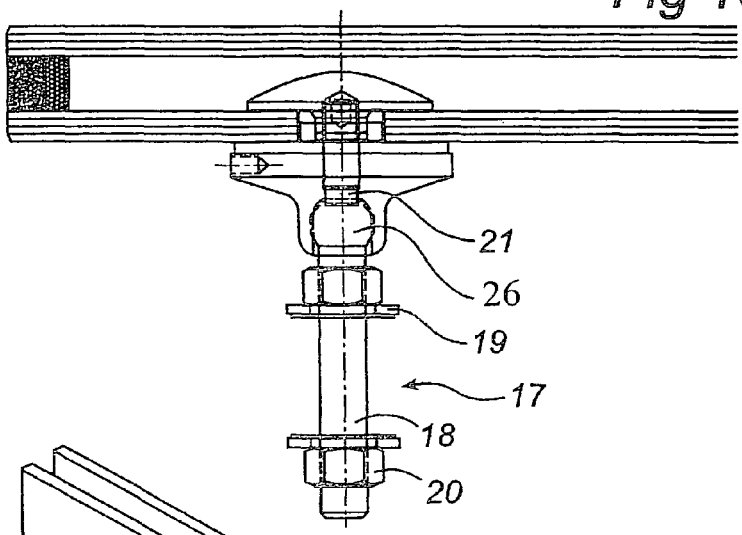

FIG. 1*e* shows the inner and the outer clamping plates 1, 14 in their final positions. In accordance with a preferred embodiment, the outer clamping plate 14 is provided with a ball joint 28, which is connected with a holder means 17. In accordance with this embodiment the holder means consists of a threaded shaft 18 and associated washers 19 and nuts 20 for anchorage to a supporting structure (not shown). The end of the ball joint 28 facing the glass element preferably is partly flat. A rubber bushing 21 preferably is provided at said flat part of the ball joint 28 in order to guide the position of the holder means 17 relative to the outer clamping plate 14. The bushing 21 guides the holder means 17 such that the threaded shaft 18 will project essentially at right angles away from the glass element when in unloaded condition. The rubber bushing 21 thus allows some spring movement in the lateral direction.

Figure 2:
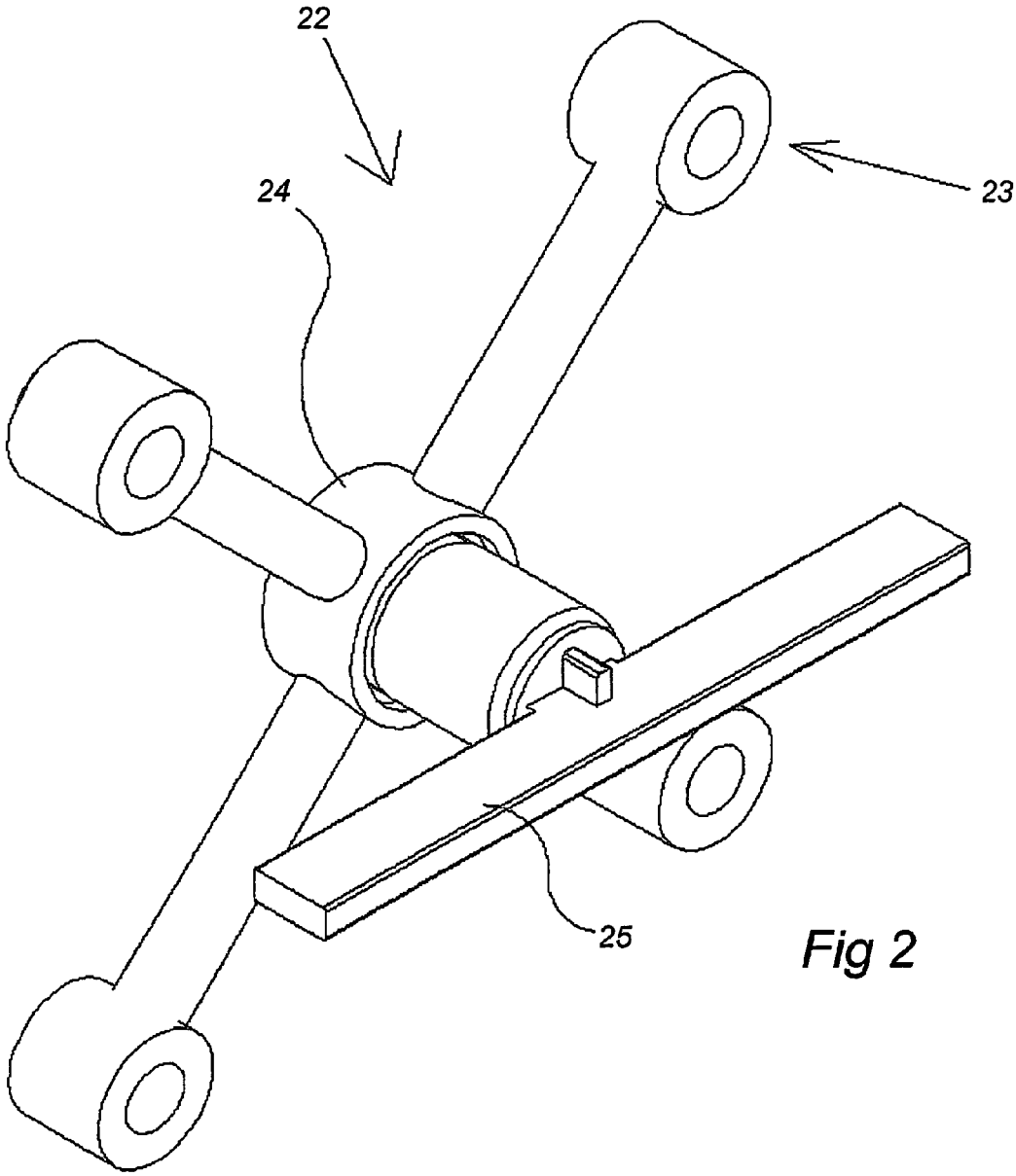
FIG. 2 shows a device comprising a support member in accordance with the present invention.

FIG. 2 shows a device 22 designed to keep four glass elements together by means of holder means and supplementary means 23 on the device 22. One of the sides of the centre portion 24 of the device 22 is to be attached to a supporting structure (not shown) and on its opposite side it is provided with a support member 25. On said support member 25 the upper juxtaposed glass elements may rest and consequently no gravitational pull from the weight of the glass elements is exerted on the apertures, wherein the clamping plates are positioned, but almost exclusively axial forces, i.e. forces in the same direction as the apertures, such as for example wind-generated loads.

Figure 3A:
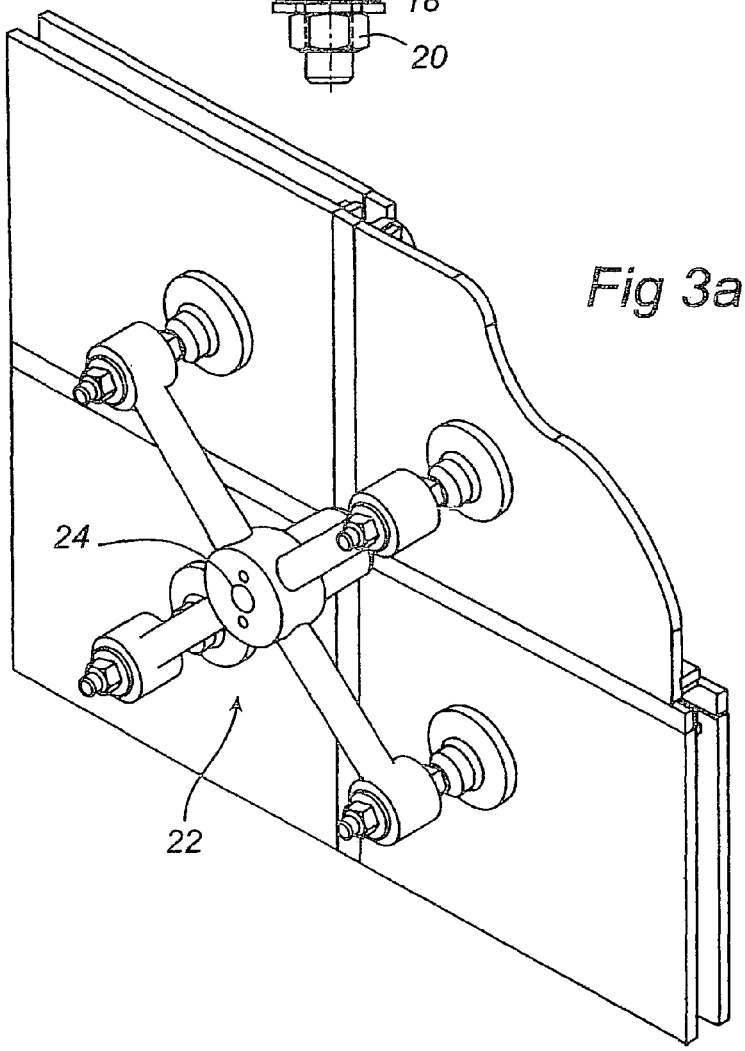
FIGS. 3*a* and 3*b* show the device of FIG. 2 as used in four glass elements.
Figure 3B:
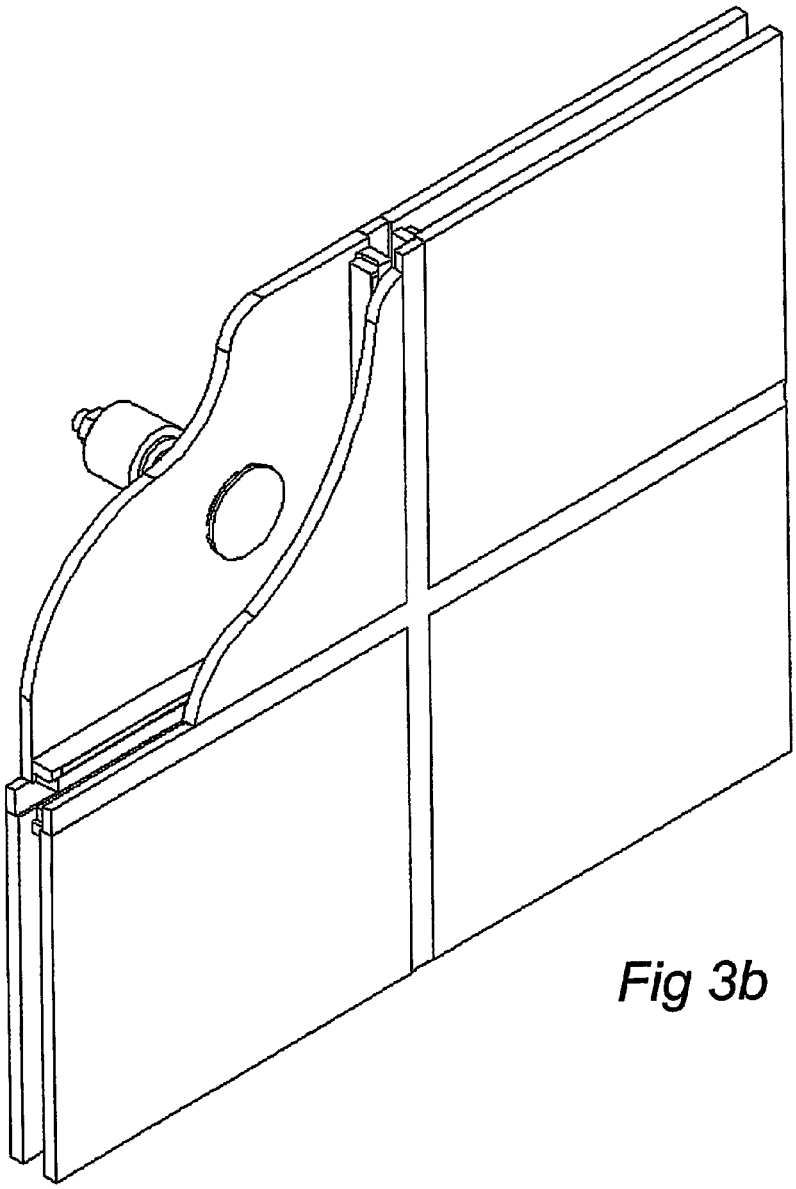

FIGS. 3*a* and 3*b* show a device 22 mounted on four glass elements. The device 22 is mounted with its centre portion 24 applied directly or indirectly to the supporting structure (not shown).

As is appreciated many modifications of the above-described embodiment of the invention are possible within the scope of protection of the invention as defined in the appended claims. For example, as described above, the clamping plates could be manufactured from other materials than stainless steel, provided that they meet the demands on strength. Additionally, the material of the components closest to the glass slabs could be made from any desired material that is sufficiently soft not to damage the glass. In addition, the connector part 15 on the outer clamping plate 14 and the connector part 6 on the inner clamping plate 1 could each one be of a kind, wherein one of the parts is pushed into the other one into engagement with one another by means of hook-shaped or barb-like means, i.e. coupling means of snap holder or bayonet fastener type.

The invention claimed is:

1. A glass element comprising:

at least two glass slabs arranged in facing relationship with a peripheral spacer frame arranged between each pair of glass slabs; and a plurality of holders for anchoring at selective points to a supporting structure, each of said plurality of holders includes two clamping plates joined together via connectors, being mounted in apertures formed in an inner glass slab facing the supporting structure, and one of the clamping plates of each holder fitting being formed with anchorage attachment points that are accessible from the outside, wherein inner clamping plates are placed in abutment against an inner face of the inner glass slab prior to an assembly of said inner glass slab and another glass slab, in such a manner that respective connecting parts extend at most up to an outer mouth of the apertures and that connecting parts of outer clamping plates, the outer clamping plates being applied to an external face of the inner glass slab in a later step, engage the connecting parts of the inner clamping plates so as to make said anchorage attachment points accessible, wherein at least one seal is arranged in said apertures in the inner glass slab and the inner clamping plates are attached to the inner face of the inner glass slab, and wherein channels are arranged in the inner clamping plates in a manner allowing flow of air between the inner mouth of the apertures and an outer face of the inner clamping plates in the mounted position.

2. A glass element as claimed in claim 1, wherein the at least one seal is formed by at least one sealing ring.

3. A glass element as claimed in claim 2, wherein a member is positioned axially externally of said sealing ring, said member being arranged to press the sealing ring outwards into a sealing position, when pressure is applied on said member to press against the inner clamping plate in a direction towards the inner clamping plate.

4. A glass element as claimed in claim 3, wherein a bevelled face is formed on the connecting parts of the inner clamping plates to guide said sealing ring, when said member and said inner clamping plates are pressed together.

5. A device in glass elements, said glass element comprising:

at least two glass slabs arranged in facing relationship with a peripheral spacer frame arranged between each pair of glass slabs;

a plurality of holders for anchoring at selective points to a supporting structure, each of said plurality of holders includes two clamping plates joined together via connectors, being mounted in apertures formed in an inner glass slab facing the supporting structure, and one of the clamping plates of each holder fitting being formed with anchorage attachment points that are accessible from the outside, wherein inner clamping plates are placed in abutment against an inner face of the inner glass slab prior to an assembly of said inner glass slab and another glass slab, in such a manner that respective connecting parts extend at most up to the outer mouth of the apertures and that connecting parts of outer clamping plates, the outer clamping plates being applied to the external face of the inner glass slab in a later step, engage the connecting parts of the inner clamping plates so as to make said anchorage attachment points accessible, the device being adapted to interconnect at least two juxtaposed/parallel glass elements at said apertures in the inner glass slabs, and being interconnectable with said supporting structure; and a support member arranged to support the two juxtaposed/parallel glass elements, wherein channels are arranged in the inner clamping plates in a manner allowing flow of air between the inner mouth of the apertures and an outer face of the inner clamping plates in the mounted position.

6. A device as claimed in claim 5, wherein seals are arranged in said aperture in the inner glass slab and wherein said inner clamping plates are attached to the inner face of the inner glass slab.

7. A glass element comprising:

at least two glass slabs arranged in facing relationship with a peripheral spacer frame arranged between each pair of glass slabs; and a plurality of holders for anchoring at selective points to a supporting structure, each of said plurality of holders includes two clamping plates joined together via connectors, being mounted in apertures formed in an inner glass slab facing the supporting structure, and one of the clamping plates of each holder fitting being formed with anchorage attachment points that are accessible from the outside, wherein inner clamping plates are placed in abutment against an inner face of the inner glass slab prior to an assembly of said inner glass slab and another glass slab, in such a manner that respective connecting parts extend at most up to an outer mouth of the apertures and that connecting parts of outer clamping plates, the outer clamping plates being applied to an external face of the inner glass slab in a later step, engage the connecting parts of the inner clamping plates so as to make said anchorage attachment points accessible, wherein gas seals including butyl are arranged in said apertures in the inner glass slab, wherein an adhesive layer is arranged between each of said inner clamping plates and the inner face of the inner glass slab, said adhesive layer attaches the inner clamping plate to the inner face of the inner glass slab, wherein the adhesion force of said adhesive layer is arranged to reach its full capacity immediately upon application of the inner clamping plates to the inner face of the inner glass slab, and wherein channels are arranged in the inner clamping plates in a manner allowing flow of air between the inner mouth of the apertures and an outer face of the inner clamping plates in the mounted position.

8. A glass element as claimed in claim 7, wherein each of said gas seals is formed by at least one sealing ring consisting of butyl.

9. A glass element as claimed in claim 7, wherein each of said gas seals is formed by at least one sealing ring, and wherein a member is positioned axially externally of said at least one sealing ring, said member being arranged to press the at least one sealing ring outwards into a sealing position, when pressure is applied on said member to press against the inner clamping plate in a direction towards the inner clamping plate.

10. A glass element as claimed in claim 9, wherein a bevelled face is formed on the connecting parts of the inner clamping plates to guide said at least one sealing ring, when said member and said inner clamping plates are pressed together.

* * * * *